United States Patent [19]

Stahlecker et al.

[11] 4,138,839

[45] Feb. 13, 1979

[54] SERVICE DEVICE FOR ONE OR MORE OPEN END SPINNING FRAMES

[76] Inventors: Fritz Stahlecker, Josef-Neidhart-Str. 18, 7341 Bad Überkingen; Hans Stahlecker, Haldenstrasse 20, 7334 Süssen, both of Fed. Rep. of Germany

[21] Appl. No.: 831,413

[22] Filed: Sep. 8, 1977

[30] Foreign Application Priority Data

Sep. 15, 1976 [DE] Fed. Rep. of Germany ..... 2641394

[51] Int. Cl.[2] ..... D01H 9/10; D01H 15/00

[52] U.S. Cl. ..... 57/270; 57/263; 57/58.89

[58] Field of Search ..... 57/34 R, 53, 58.89

[56] References Cited

U.S. PATENT DOCUMENTS

| | | | |
|---|---|---|---|
| 3,879,925 | 4/1975 | Yoshizawa et al. | 57/53 |
| 3,950,926 | 4/1976 | Stahlecker | 57/34 R |

*Primary Examiner*—Charles Gorenstein
*Attorney, Agent, or Firm*—Craig & Antonelli

[57] ABSTRACT

Servicing apparatus is provided for servicing a multiplicity of spinning assemblies arranged side by side in open end spinning frame. The apparatus includes a plurality of part instruments for performing separate servicing operations at respective ones of the spinning assemblies, such as part instruments for cleaning, piecing up operations, and spindle bobbin exchanges. Since these part instruments are geometrically wider in the travel direction thereof than are the individual spinning assemblies, the invention involves a geometric arrangement of the various parts within the part instrument so as to accommodate simultaneous servicing of adjacent spinning assemblies by two different part instruments, without the part instruments blocking one another. In preferred embodiments of the invention the parts of the mobile instrument which must directly cooperate with the parts of the individual spinning assemblies are all arranged at one edge zone of the part instrument, with associated driving mechanisms and the like being located in another zone of the part instrument. In this manner, and by placing the respective edge zones of adjacent spinning machines as facing one another in the travel direction of the part instruments, it is possible to simultaneously serve immediately adjacent spinning assemblies without the part instruments blocking one another. In certain preferred embodiments, the height of the part instruments is so limited as to permit passage of the part instruments with respect to one another and also to permit simultaneous working at different parts of a spinning assembly by two different part instruments.

17 Claims, 9 Drawing Figures

SERVICE DEVICE FOR ONE OR MORE OPEN END SPINNING FRAMES

BACKGROUND AND SUMMARY OF THE INVENTION

The invention relates to a servicing device for one or more open end spinning frames constituted by at least two function elements for execution of different servicing operations, each function element being an independently mobile part instrument, which servicing device has a traveling mechanism as well as drives and controls for said function elements.

From German OS No. 2,008,142 and U.S. Pat. No. 3,791,126 is known that mobile servicing instruments can be provided for open end spinning frames which are supposed to execute a substantially automatic piecing, cleaning or bobbin exchange or the like at the individual spinning assemblies. The servicing device comprises a single servicing instrument or a plurality of independent mobile instruments. This is advantageous because some servicing operations can be subdivided into at least two steps, namely preparatory and supplementary operations which can be effected in succession. For example the piecing process on an open end spinning assembly can be broken down into cleaning — especially cleaning of the spinning rotor — and the actual piecing operation (German OS No. 2,350,840; corresponding to U.S. Pat. No. 3,950,926). If these devices which effect the supplementary operations are disposed in independent part instruments, they can work simultaneously at different spinning assemblies so that within a given time several spinning assemblies can be completely serviced. In addition, this division into several part instruments is advantageous for reasons of construction, because many function elements can only, with some difficulty, be disposed in a single servicing instrument in such a way that they can all be presented to the same spinning assemblies.

In practice it has been found that the mobile part instruments also require a substantial amount of space in which the function elements as well as their drives and controls and the traveling mechanism with its drive can be disposed. In most cases it cannot be prevented, particularly since the space between machines that stand parallel to each other is not too large, that the part instruments will have more width than that of the spinning assemblies which are to be serviced. This has the result that in some situations two servicing instruments that are to execute supplementary servicing operations mutually block each other if adjacent assemblies are to be serviced. In this case, the following part instrument must wait idly until the leading part instrument has completed its work.

The invention is addressed to the problem of constructing part instruments of a servicing device in such a way that they do not block each other, allowing execution of work on adjacent spinning assemblies. This problem is solved in that the function elements of each part instrument are combined in an edge zone, whereas the rest of the space contains the appurtenant drives and controls, whereby the edge zones of the part instruments with the function elements that are designed to execute mutually supplementing servicing operations are turned toward each other.

This construction not only offers the advantage that the part instruments can travel close together and in some situations even work on the same assembly, but also that the part instruments are neatly grouped so that it is possible to have modular assembly construction.

In certain preferred embodiments, the part instruments which together constitute a servicing device are independently mobile, as well as detachably coupleable together for simultaneous travel. To accommodate independent travel, each of the respective part instruments have their own travel mechanism. When the part instruments are coupled together only one of the drive mechanisms need to be driven.

In certain other preferred embodiments, the part instruments only travel when coupled with another part instrument; accordingly only one travel mechanism drive is needed.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
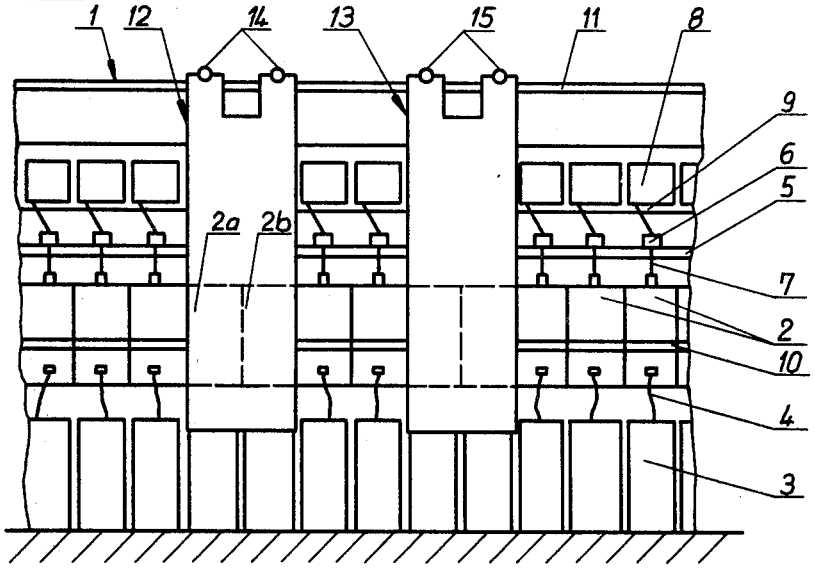
FIG. 1 is a front schematic view of part of an open end spinning frame with two mobile part instruments of a servicing device of the type contemplated by the present invention.

FIG. 1 shows the front view of a part of an open end spinning frame 1 which has a plurality of open end spinning assemblies 2 arranged next to each other, to which assemblies a sliver 4 is supplied from a can 3. Yarn 7 which is spun in a known way in spinning assembly 2 is delivered by take off rolls 5, 6 to the respective winding bobbins 8, applied to a friction roll 9. There are tracks 10, 11 disposed along open end spinning frame 1, on which by means of wheels 14, 15 that are merely schematically indicated, two part instruments 12 and 13 of a servicing device can travel in either direction. In the embodiment of FIG. 1 it is provided that part instrument 12 will move to the left and undertake preparatory operations at individual spinning assemblies 2, e.g. cleaning spinning assemblies 2, while the second part instrument 13 also follows the drive part instrument 12 to the left and executes subsequent servicing operations e.g. the piecing of broken yarn 7, on individual spinning assemblies 2. FIG. 1 shows that the part instruments 12, 13 are wider than the individual spinning assemblies 2 that are to be serviced. If the leading part instrument 12 were to execute a preparatory servicing operation at a spinning assembly **2*a*, then the following part instrument 13 would not be capable in this case of working at adjacent spinning assembly 2*b* due to the width of the part instruments 12, 13**. Below there is a description of preferred arrangements (FIGS. 5 to 9) of the part instruments so as to avoid this problem due to the greater width of the part instruments as compared to the spinning assemblies.

Figure 2:
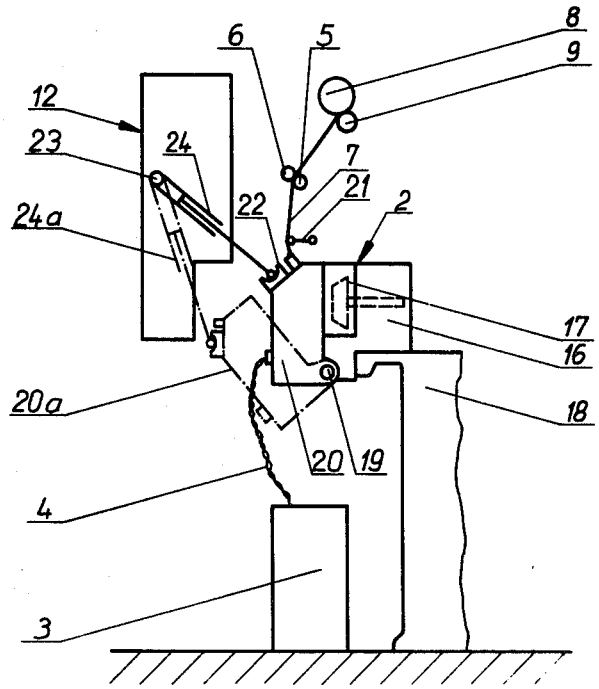
FIG. 2 is a cross sectional view through an open end spinning assembly with a part instrument executing a cleaning operation at this place.
Figure 3:
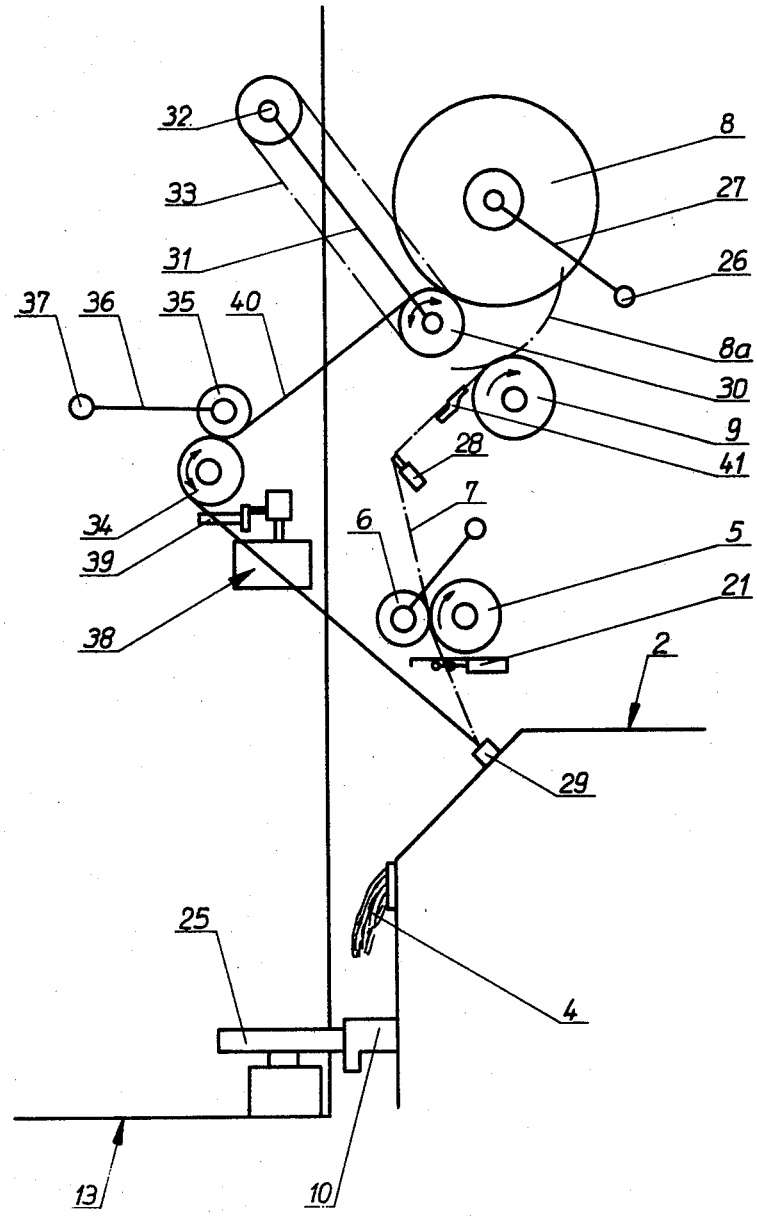
FIG. 3 is a cross section through an open end spinning assembly with a part instrument executing a piecing operation at this place.
Figure 4:
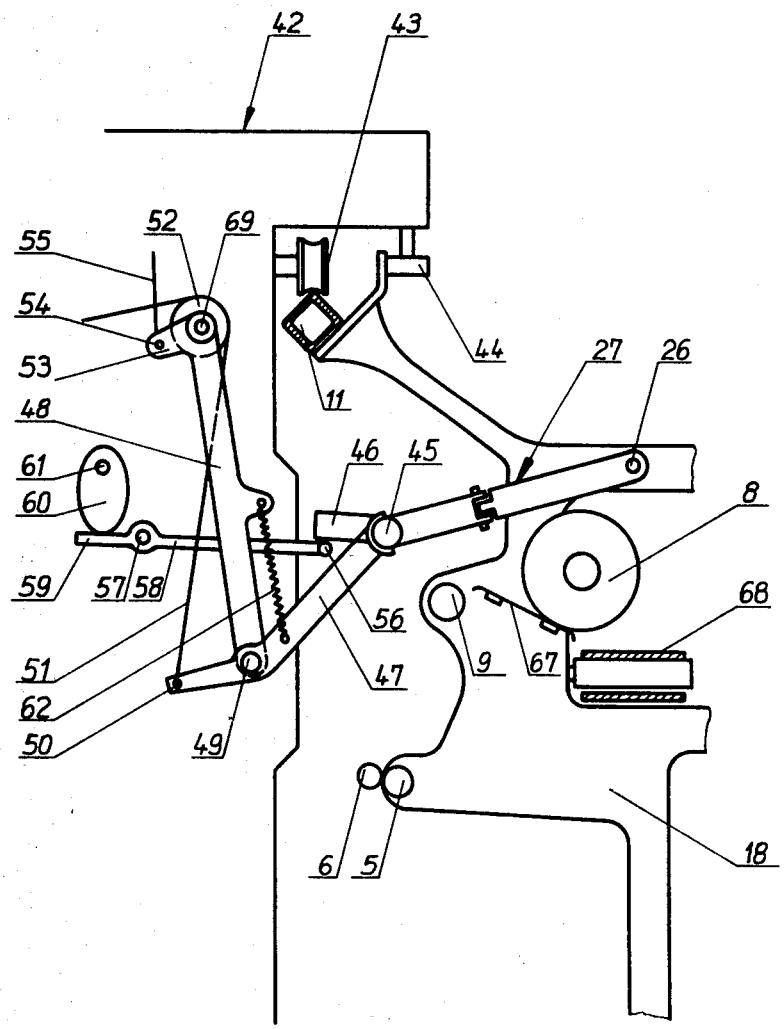
FIG. 4 is a cross section through an open end spinning assembly with a part instrument executing a bobbin exchange at this place.

It is noted briefly in connection with FIGS. 2, 3 and 4 what servicing operations can be undertaken by the individual mobile part instruments contemplated by the invention. In the schematic cross section of FIG. 2 of an open end spinning assembly 2, we see part of the elements described previously for FIG. 1, namely the supply of sliver 4 from a can 3, the yarn 7 drawn off by rolls 5, 6 from assembly 2, as well as winding bobbin 8 applied to a friction roll 9. Spinning assembly 2 includes a housing 16 fixed to the machine frame 18, in which housing an open end spinning rotor 17 is indicated by dashed lines. A housing 20 containing the feed and opener device can be swung if required about a stationary shaft 19 of housing 16, into position 20*a* that is indicated with dot-and-dash lines. After such a swinging of housing 20, open end spinning rotor 17 will be accessible to mobile part instrument 12 for a cleaning operation. The cleaning elements are omitted in FIG. 2, since known cleaning element constructions can be used to practice the invention. The function elements for opening spinning assembly 2 are only schematically indicated. For this there is a ball guide 22 on housing 20, in which the spherical end of a piston-cylinder unit 24 which is swingable about a shaft 23 can engage. Piston-cylinder unit 24 can swing into a position 24*a* and therewith swing housing 20 into position 20*a*. The cleaning operation which is not described may then take place. Thereafter the piston-cylinder unit swings housing 20 back and closes spinning assembly 2.

In the open end spinning assembly 2 that is schematically shown in FIG. 3, a yarn take off passage 29 is to be seen, from which yarn 7 is drawn off as indicated by the dot-and-dash line. Next there is a yarn monitor 21, a yarn deflecting element 28, a yarn-change guide 41, as well as friction roll 9 to which in the operational state winding bobbin is applied, as indicated by dot-and-dash lines 8*a*. In case of a yarn break, there will be no yarn 7 present. To eliminate such a yarn break is the task of part instrument 13, whereof only some function elements are indicated in order not to obscure the invention and since such function elements will be readily constructed by the skilled artesian given the state of the art and the present disclosure. Part instrument 13 includes a lift off roll 30 which can lift bobbin 8 from friction roll 9, and which can be driven in either direction of rotation. The lift off roll 30 is disposed on a lever 31 which can swing about a shaft 32 of part instrument 13. In dot-and-dash lines, numeral 33 indicates a toothed belt drive for lift off roll 30. During the piecing process, yarn 40 which is to be pieced is guided by a pair of clamping rolls 34, 35 of part instrument 13 and carried back into yarn take off passage 29. After piecing, the direction of rotation of driven clamping roll 34 will be reserved so that the pieced yarn 40 will again be drawn off from spinning assembly 2. Yarn 40 guided by paired clamping rolls 34, 35 will then be transferred via a transfer device 38, whereof a transfer lever 39 is indicated, into its operating position 7 as shown by dot-and-dash lines. Here it is necessary that the clamping roll, which is constructed as a pressure roll 35, can be swung by means of a lever 38 about the shaft 37 of drive roll 34.

In practice it has been customary to allow a mobile part instrument 12 for cleaning as in FIG. 2, to run out, then to execute a preparatory operation at a spinning assembly 2, while part instrument 13 follows part instrument 12 and subsequently effects the next servicing operations at spinning assembly 2.

A part instrument 42 with function elements for bobbin exchange is moved to the open end spinning assembly that is schematically shown in cross section in FIG. 4. This part instrument 42 exchanges full wound bobbin 8 for a new empty tube 45. Such a part instrument 42 can also cooperate with the other part instruments, e.g. with part instrument 12 which effects the cleaning. Since in bobbin exchange there is often a yarn break, it is advantageous in this case to undertake preparatory cleaning operations on the spinning assembly 2 in question on which a bobbin exchange is to be effected. Full bobbin 8 rolls on a guide plate 67 that is fixed to the machine, after it is ejected from bobbin holder 27, onto a conveyor belt 68 that extends in the long direction of the machine. A rail 11 is disposed on the machine frame, on which rollers 43, 44 of the bobbin exchange device 42 are guided.

Ejection of full bobbin 8 from bobbin holder 27 and the placing of a new empty tube 45 in holder 27 is effected by a lever mechanism 47, 48. Levers 47 and 48 which are tensioned by a spring 62 are swingable toward each other about a pin 49, while lever 48 itself is rotatable about pin 69. A tension member 55 disposed on a projection 53 of lever 48 causes a swinging of lever 48 while a tension member 51 disposed at 50 on lever 47 is responsible for the swinging of lever 47. Tension member 51 is here laid about a roll 52 that is rotatable about pin 69. There is another double lever 58, 59 on bobbin exchanger 42, swingable about 57, which with a guide 56 can be applied against a projection 46 of bobbin frame 27 and lift it. A cam 60 rotatable about shaft 61 effects the corresponding swing motion of double lever 58, 59.

The three part instruments of FIGS. 2, 3 and 4 are indicated as preferred embodiments, whereby respectively two or three of these part instruments and possibly of course other part instruments can effect actuating operations and servicing processes on open end spinning assemblies 2.

Figure 5:
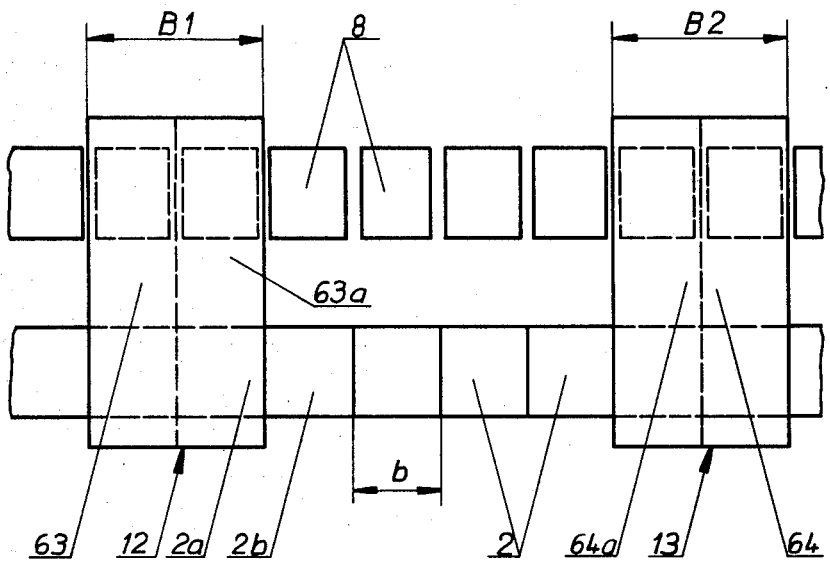
FIGS. 5 to 9 show schematically various divisions, arrangements and dispositions of part instruments of a servicing device according to preferred embodiments of the invention.

For simplification of the illustration, FIG. 5 shows, of open end spinning frame 1, only the housings of spinning assembly 2 arranged in a row, as well as the appurtenant winding bobbins 8, likewise arranged in a row. FIG. 5 also shows two mobile part instruments 12 and 13, located at random on spinning assemblies. Width B1 of part instrument 12 and width B2 of part instrument 13 is substantially greater than width b of a spinning assembly 2. In order to allow simultaneously servicing of two adjacent spinning assemblies 2*a* and 2*b* as required, by the two part instruments 12 and 13, each part instrument is divided, like prefabricated modules, into a drive part which contains the drive and the controls, and a working part that contains function elements which can be presented to the spinning assemblies. This division is indicated by the dashed line inside the servicing instrument in question. Thus part instrument 12 is divided into drive part 63 and working part 63*a*, and part instrument 13 is divided into drive part 64 and working part 64*a*. The respective working parts 63*a* and 64*a* constitute an edge zone of the part instruments and are on sides of part instruments 12 and 13 that face each other.

Figure 6:
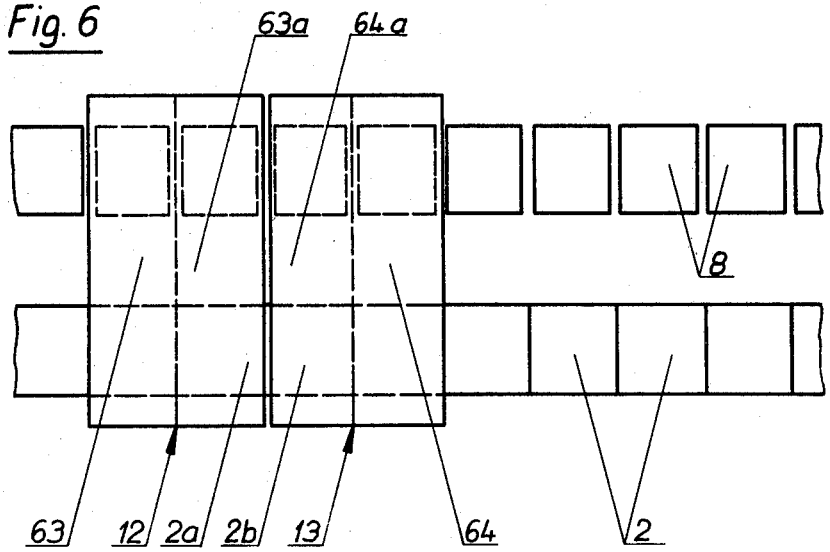

FIG. 6 shows the positioning of the two mobile pat instruments 12 and 13 which are active at the same time on adjacent spinning assemblies 2*a* 2*b*. Because the working parts 63*a* of servicing instrument 12 and 64*a* of instrument 13 are disposed on edge zones of the part instruments that are turned toward (facing) each other, even very wide part instruments can service adjacent spinning assemblies 2*a* and 2*b* without blocking each other.

Figure 7:
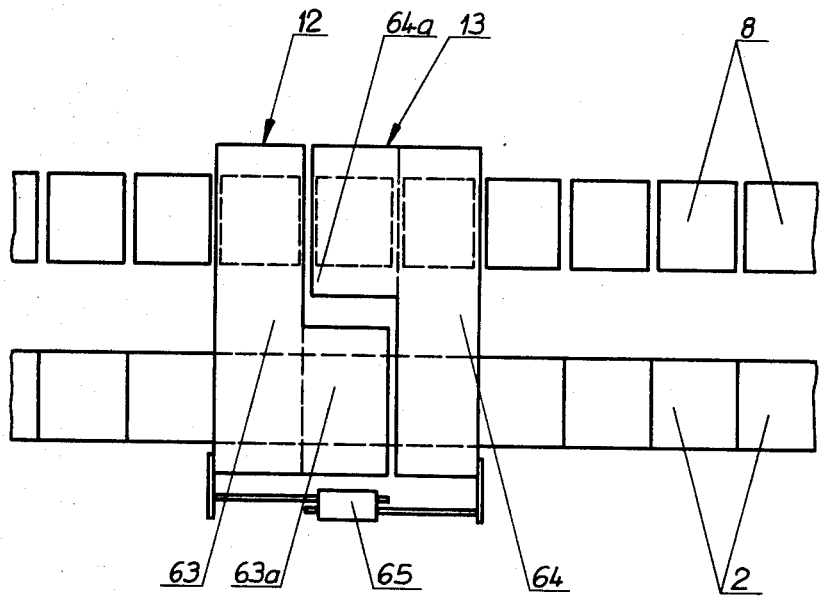

In FIG. 7 there are two part instruments 12 and 13 whose drive parts 63 and 64 extend over the total height of spinning assembly 2 while the working parts 63*a* and 64*a* are disposed in the respective edge zones that are turned toward each other, having such a low structural height that they can be placed one above the other. Thus working part 63*a* can be associated with the actual spinning assembly 2, e.g. for cleaning, and working part 64*a* can be simultaneously associated with winding device 8 of the same spinning assembly. Because of this arrangement it is possible to present working parts 63*a* and 64*a* respectively, of different part instruments 12 and 13, simultaneously to the same spinning assembly.

A coupling 65 is schematically indicated in FIG. 7, whereby part instruments 12 and 13 can be connected, if so required, for example if step by step all spinning assemblies 2 are to be serviced, one after the other.

In this embodiment of FIG. 7, as well as in the embodiment of FIGS. 5, 6, 8 and 9, it is contemplated to provide independently mobile part instruments which are detachably coupleable with one another. For accommodating independent travel, the respective part instruments have their own travel mechanisms. When the part instruments are coupled together only one travel mechanism needs to be driven.

Other embodiments of the invention are contemplated where the part instruments travel only when coupled together. In these embodiments only one travel mechanism is needed and provided.

Figure 8:
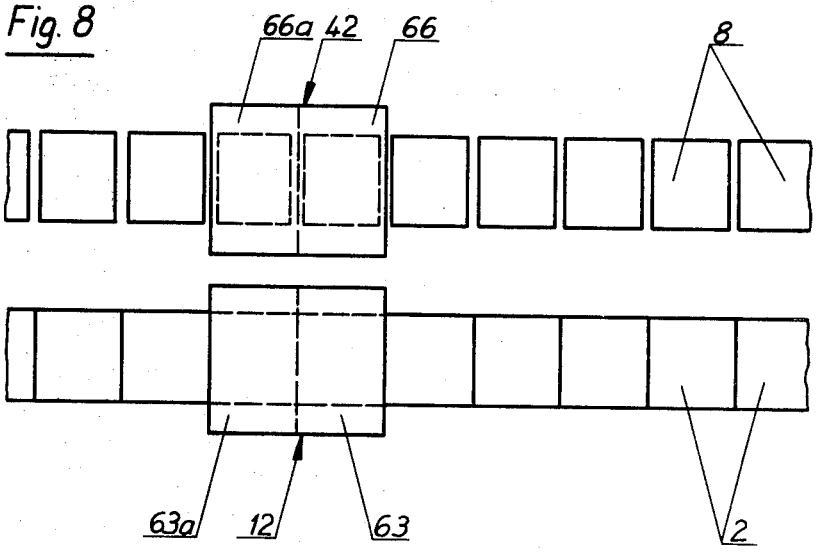

In the embodiment of FIG. 8, part instruments 12 and 42, for example at the cost of greater extent in the long direction of the machine or crosswise thereto, are so designed and so limited in their structural height that they can be moved one above the other. Here for example we have a part instrument 42 for bobbin exchange and a part instrument 12 for cleaning. The respective working parts 63*a* and 66*a* of the mobile instruments 13 and 42 are both immediately adjacent and also simultaneously presentable to the same spinning assembly. The corresponding drive parts 63 and 66 respectively are disposed in the modular system next to the respective working part.

Figure 9:
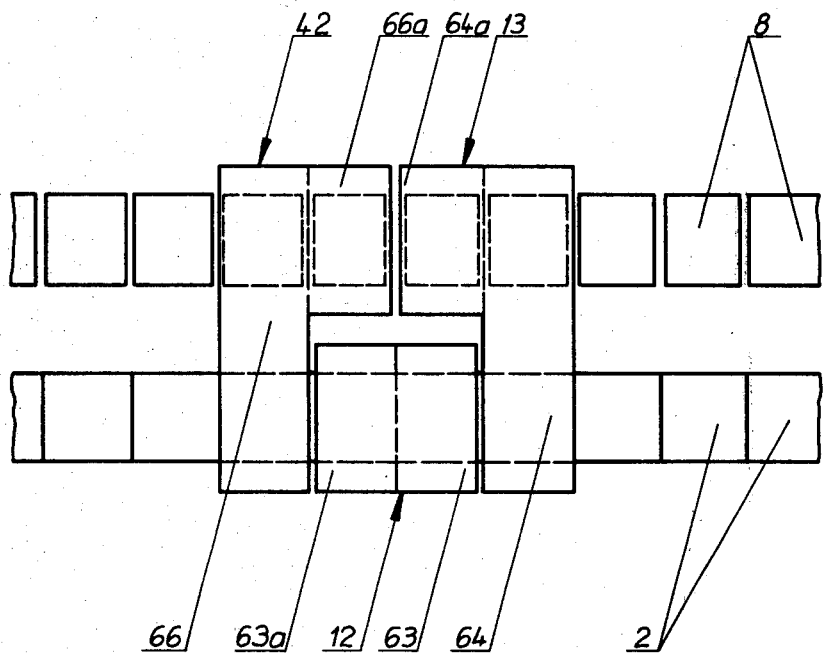

FIG. 9 shows the cooperation of a trio of independently mobile part instruments 12, 13 and 42 in accordance with yet another preferred embodiment of the invention. For example, part instrument 12 may be a cleaning device, part instrument 42 a bobbin exchanger and part instrument 13 a piecing device. In case the bobbins of all spinning assemblies 2 are to be exchanged in succession, these three part instruments 12, 13 and 42 could also be mechanically coupled together. The respective working parts 63*a*, 66*a* and 64*a* are so associated that they can simultaneously service adjacent spinning stations or even — insofar as part instrument 12 is concerned — the same spinning assembly 2. Part instruments 42 and 13 have working parts 66*a* and 64*a* that are restricted in height to the upper zone of the spinning frame, said parts being in edge zones that are turned toward each other and contain the function elements. Working parts 66*a* and 64*a* leave so much space beneath them, even if they are moved to two adjacent spinning assemblies, that below them there is room for still another part instrument 12, corresponding to the showing in FIG. 8. This part instrument 12 is likewise divided into a working part 63*a* and a drive part 63, whereby working part 63*a* advantageously is so arranged that it can be presented simultaneously with working part 66*a* to the same spinning assembly. Here it is assumed that working parts 66*a* and 63*a* do not hamper each other because they only execute servicing operations in specific regions of the spinning assembly that are distant from each other.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Servicing apparatus for servicing a plurality of spinning assemblies arranged side by side in an open end spinning frame, comprising:

a first mobile part instrument having a first set of function elements for executing a first servicing operation at respective spinning assemblies of the spinning frame, and a second mobile part instrument having a second set of function elements for esecuting a second servicing operation at respective spinning assemblies of the spinning frame, said first and second part instruments being movable between respective spinning assemblies independently of one another, wherein said first part instrument is wider in its travel direction than each of the individual spinning assemblies, wherein said first part instrument includes a first set of appurtenant drives and controls for said first set of function elements, wherein said first part instrument is divided into an edge zone and at least one other zone adjacent said edge zone in the travel direction of said first part instrument, wherein at least a portion of said first set of appurtenant drives and controls is disposed in said other zone, and wherein all portions of said first set of function elements which cooperate directly with parts of said spinning assemblies during servicing operations are disposed in said edge zone with all parts of said first part instrument positioned so as not to physically interfere with operation of said second part instrument during simultaneous performance of said first and second servicing operations at respective immediately adjacent spinning assemblies.

2. Apparatus according to claim 1, wherein said second part instrument is wider in its travel direction than each of the individual spinning assemblies, wherein said second part instrument includes a second set of appurtenant drives and controls for said second set of function elements, wherein said second part instrument is divided into an edge zone and at least one other zone adjacent said edge zone in the travel direction of said second part instrument, wherein at least a portion of said second set of appurtenant drives and controls is disposed in said other zone, wherein all portions of said second set of function elements which cooperate directly with parts of said spinning assemblies during servicing operations are disposed in aid edge zone, and wherein said edge zone of said first part instrument faces said edge zone of said second part instrument.

3. Apparatus according to claim 2, wherein each of said first and second part instruments includes a traveling mechanism for drivingly moving said first and second part instruments between servicing positions adjacent the respective spinning assemblies.

4. Apparatus according to claim 2, wherein said first and second servicing operations supplement one another.

5. Apparatus according to claim 4, wherein coupling parts are provided for selectively coupling said part instruments together.

6. Apparatus according to claim 4, wherein said first set of function elements includes means for effecting a cleaning of the spinning assembly, especially of the spinning rotor, and wherein said second set of function elements includes means for effecting a piecing operation.

7. Apparatus according to claim 6, wherein the first part instrument that executes the cleaning operation is supplementarily equipped in a zone opposite a winding device of the spinning frame with a third set of function elements for performing a bobbin exchange.

8. Apparatus according to claim 7, wherein the third set of function elements for the bobbin exchange are staggered by at least the width of one spinning assembly in the longitudinal direction of the spinning frame, with reference to the first set of function elements for the cleaning operation.

9. Apparatus according to claim 4, wherein said first set of function elements includes means for performing a bobbin exchange, wherein said second set of function elements includes means for execution of cleaning operations, and wherein said first and second part instruments are limited in height and disposed on tracks one above the other in such a way that they can pass by each other.

10. Apparatus according to claim 2, wherein said first and second part instruments are similar in height and are configured so that they cannot pass each other in the longitudinal direction of the spinning frame.

11. Apparatus according to claim 2, wherein coupling parts are provided for selectively coupling said part instruments together, and wherein control means are provided to selectively activate the traveling mechanism of only one of the part instruments so that only one traveling mechanism is needed to move both part instruments when coupled together.

12. Apparatus according to claim 2, further comprising a third mobile part instrument having a third set of function elements for executing a third servicing operation at respective spinning assemblies of the spinning frame, wherein said first set of function elements includes means for executing a bobbin exchange, wherein said second set of function elements includes means for cleaning a spinning assembly, wherein said third set of function elements includes means for a piecing operation, wherein the first set of function elements for bobbin exchange and the third set of function elements for piecing are disposed in edges zones of the respective first and third part instruments that are facing each other and are so limited in height that the second part instrument which as a whole is limited in height can be accommodated below the edge zones of the first and third part instruments.

13. Apparatus according to claim 1, wherein said edge zones are no wider than respective ones of said spinning assemblies.

14. Servicing apparatus for servicing a plurality of spinning assemblies arranged side by side in an open end spinning frame, comprising:

a first mobile part instrument having a first set of function elements for executing a first servicing operation at respective spinning assemblies of the spinning frame, and a second mobile part instrument having a second set of function elements for executing a second servicing operation at respective spinning assemblies of the spinning frame, said first and second part instruments being movable between respective spinning assemblies independently of one another, wherein said first part instrument is wider in its travel direction than each of the individual spinning assemblies, wherein said first part instrument includes a first set of appurtenant drives and controls for said first set of function elements, wherein said first part instrument is divided into an edge zone and at least one other zone adjacent said edge zone in the travel direction of said first part instrument, said edge zone being no wider than one of said spinning assemblies, wherein at least a portion of said first set of appurtenant drives and controls is disposed in said other zone, and wherein all portions of said first set of function elements which cooperate directly with parts of said spinning assemblies during servicing operations are disposed in said edge zone, wherein said second part instrument is wider in its travel direction than each of the individual spinning assemblies, wherein said second part instrument includes a second set of appurtenant drives and controls for said second set of function elements, wherein said second part instrument is divided into an edge zone and at least one other zone adjacent said edge zone in the travel direction of said second part instrument, said edge zone being no wider than one of said spinning assemblies, wherein at least a portion of said second set of appurtenant drives and controls is disposed in said other zone, wherein all portions of said second set of function elements which cooperate directly with parts of said spinning assemblies during servicing operations are disposed in said edge zone, wherein said edge zone of said first part instrument faces said edge zone of said second part instrument, wherein each of said first and second part instruments includes a traveling mechanism for drivingly moving said first and second part instruments between servicing positions adjacent the respective spinning assemblies, wherein said first and second servicing operations supplement one another, and wherein the edge zones are disposed on the part instruments in question so as to be staggered in height, whereby they can be positioned one above the other.

15. Servicing apparatus for servicing a plurality of spinning assemblies arranged side by side in an open end spinning frame, comprising:

a first mobile part instrument having a first set of function elements for executing a first servicing operation at respective spinning assemblies of the spinning frame, and a second mobile part instrument having a second set of function elements for executing a second servicing operation at respective spinning assemblies of the spinning frame, said first and second part instruments being movable between respective spinning assemblies independently of one another, wherein said first part instrument is wider in its travel direction than each of the individual spinning assemblies, wherein said first part instrument includes a first set of appurtenant drives and controls for said first set of function elements, wherein said first part instrument is divided into an edge zone and at least one other zone adjacent said edge zone in the travel direction of said first part instrument, said edge zone being no wider than one of said spinning assemblies, wherein at least a portion of said first set of appurtenant drives and controls is disposed in said other zone, wherein all portions of said first set of function elements which cooperate directly with parts of said spinning assemblies during servicing operations are disposed in said edge zone, wherein said second part instrument is wider in its travel direction than each of the individual spinning assemblies, wherein said second part instrument includes a second set of appurtenant drives and controls for said second set of function elements, wherein said second part instrument is divided into an edge zone and at least one other zone adjacent said edge zone in the travel direction of said second part instrument, said edge zone being no wider than one of said spinning assemblies, wherein at least a portion of said second set of appurtenant drives and controls is disposed in said other zone, wherein all portions of said second set of function elements which cooperate directly with parts of said spinning assemblies during servicing operations are disposed in said edge zone, wherein said edge zone of said first instrument faces said edge zone of said second part instrument, wherein said first and second servicing operations supplement one another, wherein said first set of function elements includes means for effecting a cleaning of the spinning assembly, especially of the spinning rotor, and wherein said second set of function elements includes means for effecting a piecing operation, wherein the first part instrument that executes the cleaning operation is supplementarily equipped in a zone opposite a winding device of the spinning frame with a third set of function elements for performing a bobbin exchange, and wherein the third set of function elements for the bobbin exchange are staggered by at least the width of one spinning assembly in the longitudinal direction of the spinning frame, with reference to the first set of function elements for the cleaning operation.

16. Servicing apparatus for servicing a plurality of spinning assemblies arranged side by side in an open end spinning frame, comprising:

a first mobile part instrument having a first set of function elements for executing a first servicing operation at respective spinning assemblies of the spinning frame, and a second mobile part instrument having a second set of function elements for executing a second servicing operation at respective spinning assemblies of the spinning frame, said first and second part instruments being movable between respective spinning assemblies independently of one another, wherein said first part instrument is wider in its travel direction than each of the individual spinning assemblies, wherein said first part instrument includes a first set of appurtenant drives and controls for said first set of function elements, wherein said first part instrument is divided into an edge zone and at least one other zone adjacent said edge zone in the travel direction of said first part instrument, said edge zone being no wider than one of said spinning assemblies, wherein at least a portion of said first set of appurtenant drives and controls is disposed in said other zone, wherein all portions of said first set of function elements which cooperate directly with parts of said spinning assemblies during servicing operations are disposed in said edge zone, wherein said second part instrument is wider in its travel direction than each of the individual spinning assemblies, wherein said second part instrument includes a second set of appurtenant drives and controls for said second set of function elements, wherein said second part instrument is divided into an edge zone and at least one other zone adjacent said edge zone in the travel direction of said second part instrument, said edge zone being no wider than one of said spinning assemblies, wherein at least a portion of said second set of appurtenant drives and controls is disposed in said other zone, wherein all portions of said second set of function elements which cooperate directly with parts of said spinning assemblies during servicing operations are disposed in said edge zone, wherein said edge zone of said first part instrument faces said edge zone of said second part instrument, wherein said first and second servicing operations supplement one another, and wherein said first set of function elements includes means for performing a bobbin exchange, wherein said second set of function elements includes means for execution of cleaning operations, and wherein said first and second part instruments are limited in height and disposed on tracks one above the other in such a way that they can pass by each other.

17. Servicing apparatus for servicing a plurality of spinning assemblies arranged side by side in an open end spinning frame, comprising:

a first mobile part instrument having a first set of function elements for executing a first servicing operation at respective spinning assemblies of the spinning frame, and a second mobile part instrument having a second set of function elements for executing a second servicing operation at respective spinning assemblies of the spinning frame, said first and second part instruments being movable between respective spinning assemblies independently of one another, wherein said first part instrument is wider in its travel direction than each of the individual spinning assemblies, wherein said first part instrument includes a first set of appurtenant drives and controls for said first set of function elements, wherein said first part instrument is divided into an edge zone and at least one other zone adjacent said edge zone in the travel direction of said first part instrument, said edge zone being no wider than one of said spinning assemblies, wherein at least a portion of said first set of appurtenant drives and controls is disposed in said other zone, wherein all portions of said first set of function elements which cooperate directly with parts of said spinning assemblies during servicing operations are disposed in said edge zone, wherein said second part instrument is wider in its travel direction than each of the individual spinning assemblies, wherein said second part instrument includes a second set of appurtenant drives and controls for said second set of function elements, wherein said second part instrument is divided into an edge zone and at least one other zone adjacent said edge zone in in the travel direction of said second part instrument, said edge zone being no wider than one of said spinning assemblies, wherein at least a portion of said second set of appurtenant drives and controls is disposed in said other zone, wherein all portions of said second set of function elements which cooperate directly with parts of said spinning assemblies during servicing operations are disposed in said edge zone, wherein said edge zone of said first part instrument faces said edge zone of said second part instrument, and further comprising a third mobile part instrument having a third set of function elements for executing a third servicing operation at respective spinning assemblies of the spinning frame, wherein said first set of function elements includes means for executing a bobbin exchange, wherein said second set of function elements includes means for cleaning a spinning assembly, wherein said third set of function elements includes means for a piecing operation, wherein the first set of function elements for bobbin exchange and the third set of function elements for piecing are disposed in edge zones of the respective first and third part instruments that are facing each other and are so limited in height that the second part instrument which as a whole is limited in height can be accommodated below the edge zones of the first and third part instruments.

* * * * *